US009399994B2

(12) United States Patent
Izutsu et al.

(10) Patent No.: US 9,399,994 B2
(45) Date of Patent: Jul. 26, 2016

(54) INTERNAL GEAR PUMP

(71) Applicant: YAMADA MANUFACTURING CO., LTD, Kiryu-shi (JP)

(72) Inventors: Masato Izutsu, Isesaki (JP); Takatoshi Watanabe, Isesaki (JP); Junichi Miyajima, Isesaki (JP)

(73) Assignee: YAMADA MANUFACTURING CO., LTD., Kiryu-shi, Gunma (JP)

( * ) Notice: Subject to any disclaimer, the term of this patent is extended or adjusted under 35 U.S.C. 154(b) by 125 days.

(21) Appl. No.: 14/088,220

(22) Filed: Nov. 22, 2013

(65) Prior Publication Data

US 2014/0154119 A1 Jun. 5, 2014

(30) Foreign Application Priority Data

Nov. 30, 2012 (JP) ..... 2012-263018

(51) Int. Cl.

| | |
|---|---|
| ***F04C 28/22*** | (2006.01) |
| ***F04C 2/10*** | (2006.01) |
| ***F04C 14/22*** | (2006.01) |
| ***F04C 18/20*** | (2006.01) |
| ***F04C 14/10*** | (2006.01) |
| ***F04C 18/10*** | (2006.01) |

(52) U.S. Cl.

CPC . *F04C 28/22* (2013.01); *F04C 2/10* (2013.01); *F04C 14/10* (2013.01); *F04C 14/226* (2013.01); *F04C 18/10* (2013.01)

(58) Field of Classification Search

USPC ..... 418/19, 150

See application file for complete search history.

(56) References Cited

FOREIGN PATENT DOCUMENTS

| | | | |
|---|---|---|---|
| EP | 0 846 861 | A1 | 6/1998 |
| JP | 2008-215326 | A | 9/2008 |
| JP | 2012-132356 | A | 7/2012 |
| SE | 0802007 | A1 | 3/2010 |
| WO | WO 2005/019650 | A1 | 3/2005 |

OTHER PUBLICATIONS

English Machine Translation of WO 2005/019650 A1 (translated on Apr. 20, 2015).*

European Search Report dated Feb. 3, 2014.

Japanese Office Action dated Mar. 17, 2015.

* cited by examiner

*Primary Examiner* — Kenneth Bomberg

*Assistant Examiner* — Paul Thiede

(74) *Attorney, Agent, or Firm* — McGinn IP Law Group PLLC

(57) ABSTRACT

The internal gear pump includes: an inner rotor; an outer rotor that rotates by having predetermined eccentricity to a rotation center of the inner rotor; an outer ring that holds the outer rotor in a freely rotatable state, and is also formed with at least three cam protruded parts; a pump housing having a rotor chamber; protruded-wall surface parts that are formed on an inner periphery side surface of the rotor chamber and are also formed in the same number as that of the cam protruded parts; and operation means for oscillating the outer ring. A diameter center of the holding-inner peripheral part of the outer ring is moved by the operation means along a locus of a circle of which a radius is the eccentricity to the rotation center of the inner rotor.

5 Claims, 6 Drawing Sheets

Fig. 1A
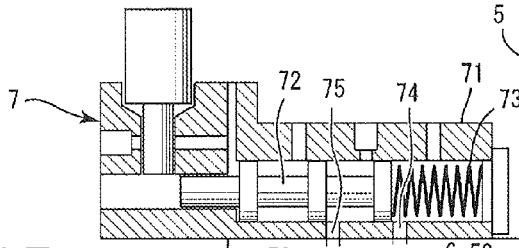
Fig. 1B
ENLARGED (α) PART
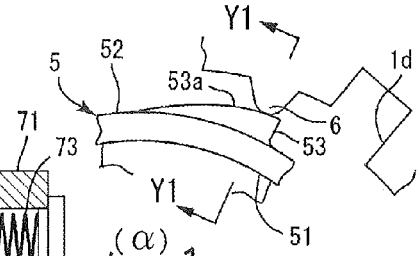
Fig. 1D
ENLARGED (γ) PART
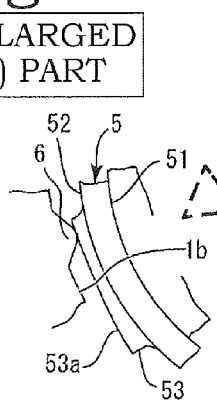
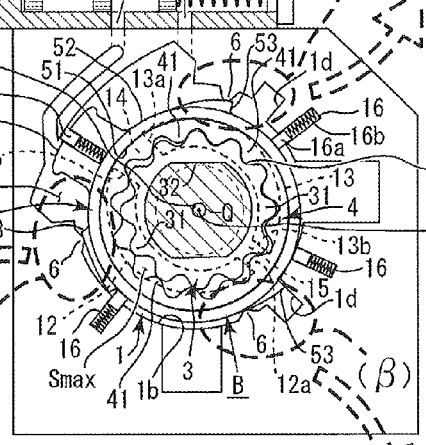
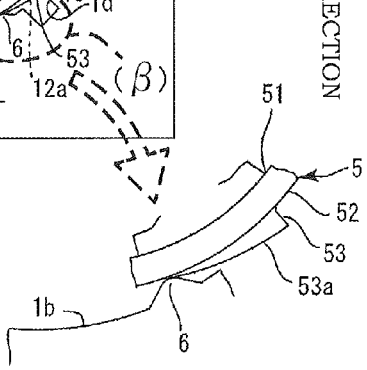
ENLARGED (β) PART
Fig. 1C
Fig. 1E
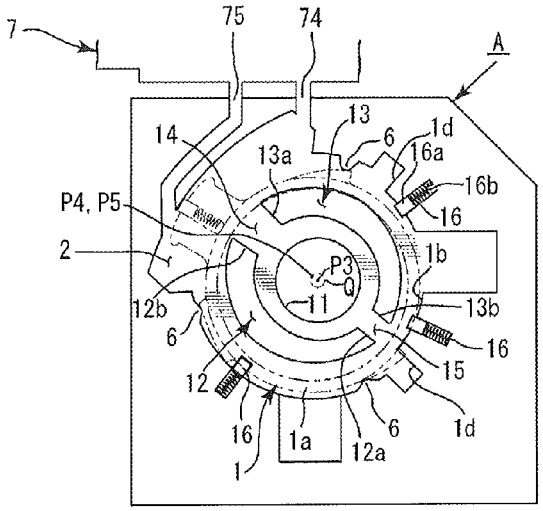

$\theta' = k\,\theta m$

ENLARGED (ε) PART $$x' = (x + e*\cos\theta m)*\cos(\theta m*k) - (y - e*\cos\theta m)*\sin(\theta m*k)$$

$$y' = (x + e*\cos\theta m)*\cos(\theta m*k) + (y - e*\cos\theta m)*\cos(\theta m*k) + e$$

$$\theta' = k\,\theta m$$

INTERNAL GEAR PUMP

BACKGROUND OF THE INVENTION

1. Field of the Invention

The present invention relates to an internal gear pump capable of varying a discharge quantity of a fluid by causing an inner rotor to change a position of an outer rotor to which the inner rotor is brought into contact, with this internal gear pump capable of being easily manufactured and also capable of maintaining high product precision.

2. Description of the Related Art

Conventionally, there have been internal gear pumps that include an inner rotor and an outer rotor with which the inner rotor is brought into contact. As this kind of an internal gear pump, there exists a variable-capacity type internal gear pump that has an outer rotor having a rotation center at a position eccentric to a rotation center of an inner rotor which has a fixed position. The rotation center of the outer rotor moves along a locus of a circle of which a radius is the eccentricity to the rotation center of the inner rotor.

The variable-capacity type internal gear pump has a base line connecting between the rotation center of the inner rotor and the rotation center of the outer rotor. The base line rotates around the rotation center of the inner rotor.

There are various kinds of internal gear pumps that include such means for moving the outer rotor along a predetermined locus. The oil pump described in Japanese Patent Application Laid-open No. 2012-132356 is outlined below as an example. In the following description, reference numbers attached to members are those used in Japanese Patent Application Laid-open No. 2012-132356.

The oil pump described in Japanese Patent Application Laid-open No. 2012-132356 includes the adjusting ring 14 for moving the outer rotor 13 in a predetermined locus. At the casing 1 side of the oil pump, there are provided concave shape portions such as a guide groove, and convex shape portions including guide pins and protruded parts. The adjusting ring 14 moves along the concave shape portions and the convex shape portions via a moving means.

SUMMARY OF THE INVENTION

The oil pump described in Japanese Patent Application Laid-open No. 2012-132356 has the following problems or disadvantages. In general, the casing 1 of the oil pump is manufactured by casting an aluminum alloy. As described above, the concave shape and the convex shape in the casing 1 are required to have particularly high dimensional precision. That is, the concave shape and the convex shape require dimensional precision approximately equivalent to that of a teeth form of a rotor of the oil pump. Specifically, dimensional precision of about ±20 μm to ±30 μm is necessary.

However, it is difficult to obtain dimensional precision of ±20 μm to ±30 μm by only casting the aluminum alloy (without cutting work). Therefore, concave shape parts and convex shape parts at the side of the casing 1 manufactured by casting the aluminum alloy are required to generate higher dimensional precision by performing the cutting work. As a result, the oil pump becomes very expensive, and also has a long manufacturing time.

A small volume of contaminants (foreign matters) are present in the oil. When the contaminants (foreign matters) are adhered to the concave shape portions such as the guide groove of the casing 1, the contaminants cannot be discharged because of the shape of concavity. Therefore, the contaminants continue to be pooled in the concave shape portion such as the guide groove. In such a situation, when the convex shape portion of the adjusting ring 14 slides into the concave shape portion of the casing 1, the convex shape portion is hung up at a portion where the contaminants of the concave shape portion are pooled. This has a risk of interrupting smooth movement of the adjusting ring.

An object of the present invention is to provide a variable-capacity type internal gear pump that includes an inner rotor and an outer rotor which is brought into contact with the inner rotor, and that has an extremely simple structure and also has high precision as a manufactured product.

As a result of intensive studies carried out to solve the above problem, as a first aspect of the present invention, the present inventor has provided an internal gear pump including: an inner rotor; an outer rotor that rotates by having predetermined eccentricity to a rotation center of the inner rotor; an outer ring that includes a holding-inner peripheral part which holds the outer rotor in a freely rotatable state, and at least three cam protruded parts formed along a circumferential direction of an outer periphery surface of the outer ring; a pump housing that has a rotor chamber in which the outer ring is freely oscillatably arranged; protruded-wall surface parts that are formed on an inner periphery side surface of the rotor chamber, are formed in the same number as that of the cam protruded parts, and are always brought into contact with the cam protruded parts; and operation means for oscillating the outer ring. Positions of the protruded-wall surface parts are set so that a diameter center of the holding-inner peripheral part of the outer ring is moved by the operation means along a locus of a circle of which a radius is the eccentricity to the rotation center of the inner rotor.

As a second aspect of the present invention, the present inventor has solved the above problem by providing the internal gear pump according to the first aspect, wherein in contacting and sliding between the protruded-wall surface parts and the cam protruded parts, the protruded-wall surface parts are brought into point contact with the cam protruded parts at the same portions. As a third aspect of the present invention, the present inventor has solved the above problem by providing the internal gear pump according to the first or second aspect, wherein the protruded-wall surface parts have arc shapes at portions that are brought into contact with the cam protruded parts.

As a fourth aspect of the present invention, the present inventor has solved the above problem by providing the internal gear pump according to any one of the first to third aspects, wherein in the rotor chamber, stopper wall surface parts with which the cam protruded parts are brought into contact are formed to control an oscillation angle of the outer ring to be within a predetermined range.

In the first aspect of the present invention, the outer ring for moving the outer rotor includes the holding-inner peripheral part which holds the outer rotor in a freely rotatable state, and at least three cam protruded parts formed at predetermined intervals along a circumferential direction of an outer periphery surface. On the inner periphery side surface of the rotor chamber of the pump housing, protruded-wall surface parts are formed by the same number as that of the cam protruded parts of the outer ring. Respective protruded-wall surface parts are always brought into contact with corresponding cam protruded parts.

Because the outer ring is oscillated by the operation means, and also because the cam protruded parts of the outer ring are configured to be always brought into contact with the protruded-wall surface parts, the outer ring can move by being guided along a predetermined locus (a locus of a circle) following the shape of the cam protruded parts that are brought into contact with the protruded-wall surface parts. Accordingly, a discharge quantity of the internal gear pump can be adjusted.

Because the internal gear pump according to the present invention is configured as described above, a locus of movement of the outer ring is not determined by the convex shape portions and the concave shape portions on the inner periphery side surface of the rotor chamber of the pump housing, but is determined along the shape of the cam protruded parts that are formed on the outer ring.

That is, according to one embodiment of the present invention, the inner periphery side surface of the rotor chamber is not required to be finished in high dimensional precision, and it is sufficient that finishing work by cutting and the like is performed to only positions where the protruded-wall surface parts are formed. Based on this, a finishing range becomes remarkably smaller than that by the cutting work of forming the inner surface of the casing in a complex curve as required by the prior art. Further, the finishing work can be in high precision, and a manufacturing time can be also shortened.

BRIEF DESCRIPTION OF THE DRAWINGS

FIG. 1A is a front view showing a configuration of an inside of an internal gear pump according to the present invention, FIG. 1B is an enlarged view of a portion (α) in FIG. 1A, FIG. 1C is an enlarged view of a portion (β) in FIG. 1A, FIG. 1D is an enlarged view of a portion (γ) in FIG. 1A, and FIG. 1E is a front view of a pump housing;

DESCRIPTION OF THE PREFERRED EMBODIMENTS

Figure 2A:
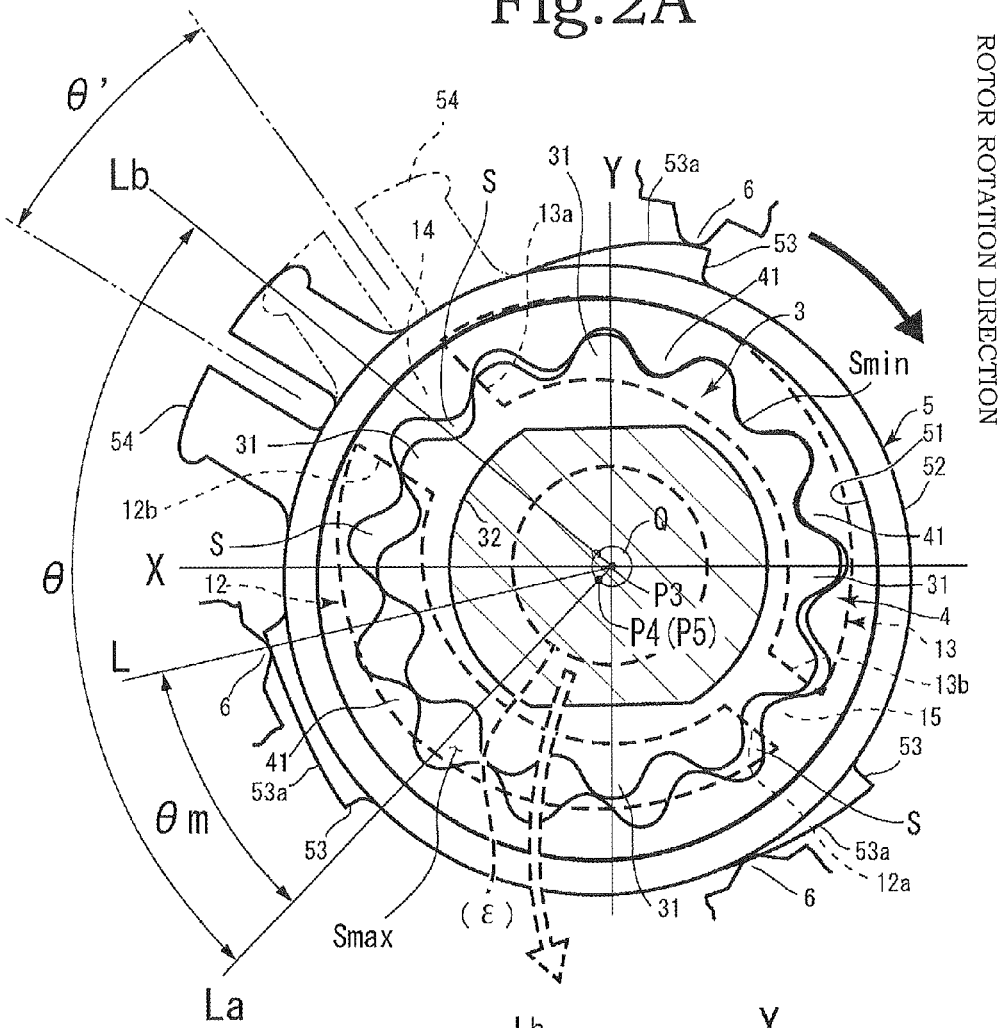
FIG. 2A is an enlarged view of an operation state of an outer ring, an outer rotor, and an inner rotor.
Figure 2B:
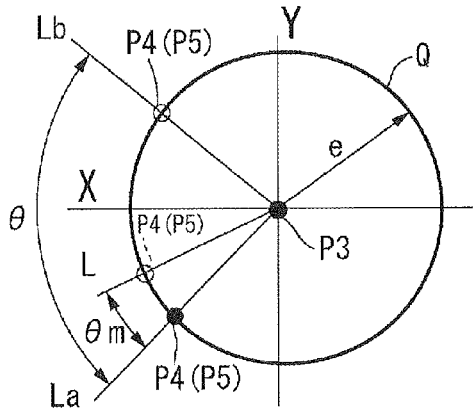
FIG. 2B is an enlarged view of a portion (ϵ) in FIG. 2A.

Hereinafter, an embodiment of the present invention is described with reference to the drawings. As shown in FIG. 1A, FIGS. 2A and 2B, etc., an internal gear pump according to the present invention is mainly configured by a pump housing A, an inner rotor 3, an outer rotor 4, a guiding means B, and an operation means 7. The guiding means B is configured by an outer ring 5, and protruded-wall surface parts 6.

As shown in FIGS. 1A and 1E, a rotor chamber 1 and an operation chamber 2 are formed in the pump housing A. A shaft hole 11 in which a drive shaft for driving the pump is formed on a bottom surface 1*a* of the rotor chamber 1. A suction port 12 and a discharge port 13 are formed around the shaft hole 11. A partition part is formed between the suction port 12 and the discharge port 13.

The partition part is formed at two positions in the rotor chamber 1. One of the partition parts is positioned between a terminal edge part 12*b* of the suction port 12 and a start edge part 13*a* of the discharge port 13. This partition part is referred to as a first partition part 14 (see FIG. 1E and FIG. 2A). The other partition part is positioned between a terminal edge part 13*b* of the discharge port 13 and a start edge part 12*a* of the suction port 12. This partition part is referred to as a second partition part 15 (see FIG. 1E and FIG. 2A).

Figure 3A:
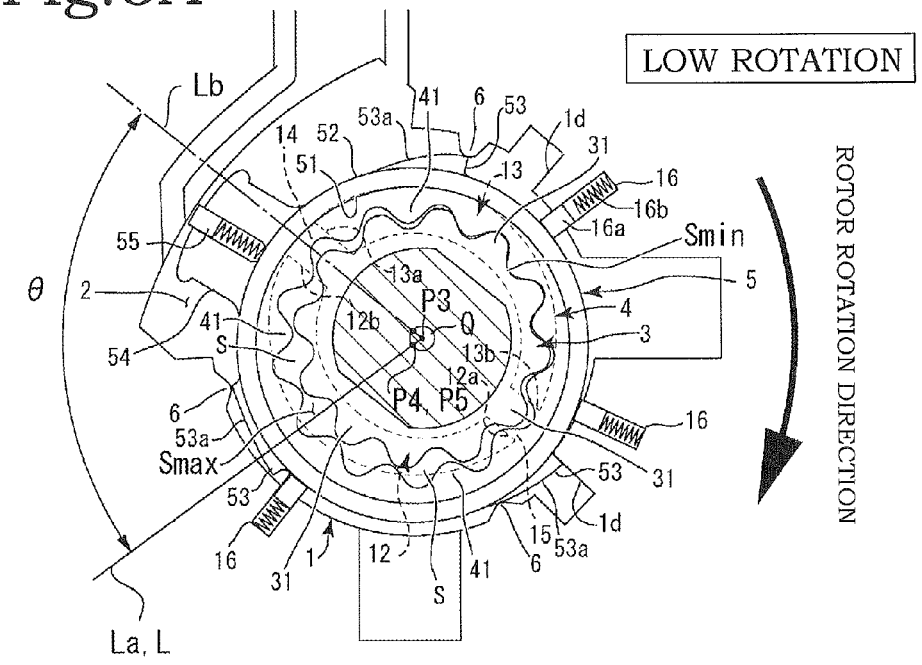
FIG. 3A is a view of a state that the outer rotor is positioned on an initial base line relative to the inner rotor at a low rotation time.
Figure 3B:
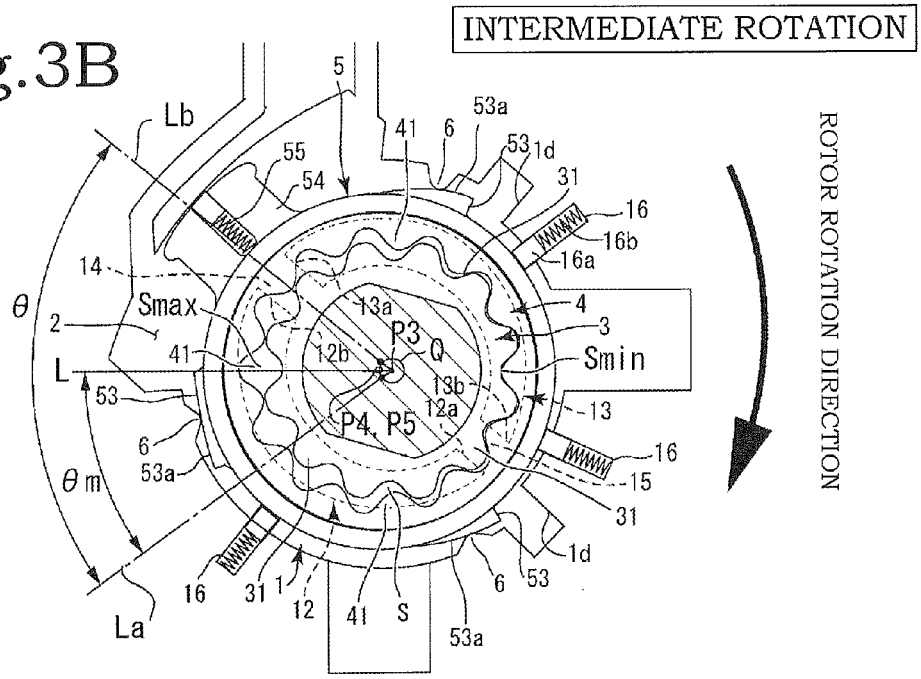
FIG. 3B is a view of a state that the outer rotor moved from the initial base line based on oscillation of the outer ring to the inner rotor at an intermediate rotation time.

In the rotor chamber 1, there are installed an inner rotor 3, an outer rotor 4, and an outer ring 5 (see FIG. 1A and FIG. 3A). In the operation chamber 2, there are installed members that configure the operation means 7. The rotor chamber 1 and the operation chamber 2 are communicated with each other. The surrounding of the bottom surface 1*a* is an inner periphery side surface 1*b*.

The inner rotor 3 is a gear having a trochoid shape or approximately a trochoid shape. In the description of the present invention, rotation directions of the inner rotor 3 and the outer rotor 4 are clockwise directions in the drawings. The inner rotor 3 is formed with a plurality of outer teeth 31. A boss hole 32 for driving is formed at a diameter-direction center position, and a drive shaft is pierced through and fixed in the boss hole 32. The boss hole 32 is formed as non-circular. A shaft-fixing part in approximately the same shape as that of the boss hole 32 is fixed to the inner rotor 3 as the drive shaft by means of fixing such as pressuring into the boss hole 32. The inner rotor 3 is rotated by rotation drive of the drive shaft.

The outer rotor 4 is formed in a ring shape, and is formed with a plurality of inner teeth 41 at an inner periphery side. The number of the outer teeth 31 of the inner rotor 3 is configured to be smaller by one than a number of the inner teeth 41 of the outer rotor 4. A plurality of inter-teeth spaces S are configured by the outer teeth 31 of the inner rotor 3 and the inner teeth 41 of the outer rotor 4. When the inter-teeth space S passes through the first partition part 14, a closed space is configured, and the closed space becomes a maximum inter-teeth space Smax having a maximum volumetric capacity.

A rotation center of the inner rotor 3 is designated as P3 (see FIGS. 2A and 2B). The rotation center P3 is at a fixed position relative to the rotor chamber 1. A rotation center of the outer rotor 4 is designated as P4. A virtual line that connects between the rotation center P3 and the rotation center P4 is referred to as a base line L. The base line L is operated by the guiding means B and the operation means 7 between an initial base line La and a terminal base line Lb to be described later, and oscillates in a circumferential direction around the rotation center P3 of the inner rotor 3.

The rotation center P3 of the inner rotor 3 is separated from the rotation center P4 of the outer rotor 4, and this separated distance is referred to as eccentricity e. The eccentricity e is for maintaining an optimum chip clearance between the inner teeth 41 and the outer teeth 31 by allowing the inner rotor 3 and the outer rotor 4 to rotate by always maintaining a constant distance between the rotors (see FIGS. 2A and 2B).

The guiding means B is for oscillating the outer rotor 4 from the initial base line La to the terminal base line Lb of the base line L in a range of an angle θ (see FIGS. 3A and 3B to FIGS. 5A and 5B). The guiding means B is configured by the outer ring 5 and the protruded-wall surface parts 6. The outer ring 5 is for changing the angle of the base line L by oscillating the rotation center P4 of the outer rotor 4. The outer ring 5 is formed in approximately a ring shape, and an inner periphery side of the outer ring 5 is referred to as a holding-inner peripheral part 51 (see FIG. 2A). Further, on the outer ring 5, an oscillation-operation protruded part 54 to be oscillated by the operation means 7 described later is formed in stretch from an outer periphery side surface to a diameter outside direction (see FIG. 1A and FIG. 3A).

The holding-inner peripheral part 51 is formed as a circular inner wall surface. An internal diameter of the holding-inner peripheral part 51 is the same as an external diameter of the outer rotor 4. Actually, the internal diameter of the holding-inner peripheral part 51 is slightly larger than the external diameter of the outer rotor 4. In order to enable the outer rotor 4 to rotate smoothly, the outer rotor 4 is inserted into the holding-inner peripheral part 51, with a clearance between the holding-inner peripheral part 51 and the outer rotor 4. This configuration is also included in the same concept.

That is, a diameter center P5 of the holding-inner peripheral part 51 of the outer ring 5 is configured to match the rotation center P4 of the outer rotor 4 in a state that the outer rotor 4 is inserted into the holding-inner peripheral part 51 (see FIGS. 2A and 2B). In the rotor chamber 1, the outer ring 5 has the outer rotor 4 arranged in the holding-inner peripheral part 51, and supports the outer rotor 4 in a stable state. At the same time, the outer ring 5 oscillates the outer rotor 4 along a locus Q of a circle of which a radius is the eccentricity e to the rotation center P3 of the inner rotor 3 via the operation means 7 described later (see FIGS. 3A and 3B and FIGS. 4A and 4B).

The outer ring 5 is installed in the rotor chamber 1 of the pump housing A, and is configured to be able to oscillate freely in the rotor chamber 1. For this purpose, the rotor chamber 1 is formed to be slightly wider than an external shape of the outer ring 5, and a space in which the outer rotor 4 oscillates is additionally provided.

A locus of the oscillation of the outer ring 5 is determined. The diameter center P5 of the outer ring 5 oscillates along the locus Q of a circle of which a radius is the eccentricity e to the rotation center P3 of the inner rotor 3 (see FIGS. 2A and 2B). The eccentricity e is the separated distance between the rotation center P3 of the inner rotor 3 and the rotation center P4 of the outer rotor 4, as described above. Because the internal diameter of the holding-inner peripheral part 51 of the outer ring 5 and the external diameter of the outer rotor 4 are approximately equal to each other, the diameter center P5 of the holding-inner peripheral part 51 and the rotation center P4 of the outer rotor 4 inserted into the holding-inner peripheral part 51 are in a matched state.

Therefore, based on the oscillation of the outer ring 5, the rotation center P4 of the outer rotor 4 oscillates around the rotation center P3 along the locus Q of a circle while maintaining the rotation center P3 of the inner rotor 3 and the eccentricity e. Accordingly, the angle of the base line L connecting between the rotation center P3 and the rotation center P4 also changes (see FIGS. 2A and 2B).

In the present invention, because the outer rotor 4 oscillates to the inner rotor 3, the outer rotor 4 has an initial position and a terminal position. The initial position is in a state that the base line L matches the initial base line La. In this state, the maximum inter-teeth space Smax having a maximum volumetric capacity among the inter-teeth spaces S formed by the outer teeth 31 of the inner rotor 3 and the inner teeth 41 of the outer rotor 4 passes through the suction port 12 (see FIG. 2A and FIG. 3A).

The terminal position is in a state that the base line L matches the terminal base line Lb. In this state, a position of the maximum inter-teeth space Smax passes on the terminal base line Lb, with the maximum inter-teeth space Smax passing on the first partition part 14 (see FIG. 4B).

An angle at which the outer ring 5 actually oscillates from the initial position to the terminal position is designated as θ', and an angle formed by the initial base line La and the terminal base line Lb is designated as θ. The angle θ' becomes smaller than the angle θ. That is, by means of the operation means 7, a slight movement of the oscillation-operation protruded part 54 of the outer ring 5 can induce a great change in a relative angle between the inner rotor 3 and the outer rotor 4 from the initial base line La to the terminal base line Lb, by (see FIGS. 2A and 2B).

At least three cam protruded parts 53 are formed at predetermined intervals along a circumferential direction of the outer periphery surface 52 of the outer ring 5 (see FIGS. 1A to 1E, FIG. 2A, and FIGS. 5A and 5B). The cam protruded parts 53 are portions that are brought into contact with the protruded-wall surface parts 6 described later and that also slide to the protruded-wall surface parts 6. Specifically, the cam protruded parts 53 are formed at approximately equal intervals in a circumferential direction of the outer periphery surface 52 of the outer ring 5. When the cam protruded parts 53 are formed by three, the cam protruded parts 53 are formed at intervals of an angle of about 120 degrees.

The cam protruded parts 53 are formed within a predetermined range of the outer periphery surface 52 in a circumferential direction thereof. This range is approximately equivalent to a maximum range of slide of the outer ring 5 to the protruded-wall surface part 6. The cam protruded parts 53 are formed with cam sliding surfaces 53*a*. The cam sliding surface 53*a* of each cam protruded part 53 is formed in a shape of an inclined surface that is gradually separated from the outer periphery surface 52 from one end toward the other end along the circumferential direction.

Specifically, the cam sliding surface 53*a* is formed in a curve similar to a trochoid curve based on the outer periphery surface 52. Inclined directions of adjacent cam protruded parts 53 are not necessarily the same and are opposite in some cases. A shape of the cam sliding surface 53*a* of each cam protruded part 53 is not limited to a trochoid curve shape, and is formed as a flat inclined surface in some cases. Although the number of the cam protruded parts 53 is set as three, more cam protruded parts 53 are formed in some cases.

The protruded-wall surface parts 6 are portions that are integrally formed in projection with the inner periphery side surface 1*b* of the rotor chamber 1 from the inner periphery side surface 1*b* toward the center (see FIG. 1E). The protruded-wall surface parts 6 are formed by the same number as the number of the cam protruded parts 53 of the outer ring 5. The protruded-wall surface parts 6 formed at a plurality of positions on the inner periphery side surface 1*b* of the rotor chamber 1 surround the outer ring 5, and are provided to be always brought into contact with the corresponding cam protruded parts 53 (see FIG. 2A, and FIGS. 3A to 3B to FIGS. 5A and 5B). By the operation means described later, positions of the respective protruded-wall surface parts 6 are set and shapes of the cam sliding surfaces 53*a* are set so that the diameter center P5 of the holding-inner peripheral part 51 of the outer ring 5 moves to the rotation center P3 of the inner rotor 3 along the locus Q of a circle of which a radius is the eccentricity e.

Because the protruded-wall surface parts 6 are formed in a circular shape in the cross-section, portions of the protruded-wall surface parts 6 that are brought into contact with the cam sliding surfaces 53*a* of the cam protruded parts 53 of the outer ring 5 are always the same portions, and are also in approximately point contact (see FIGS. 1A, 1B, 1C, 1D, and FIGS.

2A and 2B). By arranging that the protruded-wall surface parts 6 are brought into approximately point contact with the same portions of the cam sliding surfaces 53*a* of the cam protruded parts 53 of the outer ring 5, ranges that require high dimensional precision can be minimized.

There is also another embodiment according to which the protruded-wall surface parts 6 have arc shapes at only portions that are brought into contact with the cam sliding surfaces 53*a* of the cam protruded parts 53. There is also a case that cross-sectional shapes of the protruded-wall surface parts 6 that are orthogonal with a longitudinal direction are set in triangular shapes so that the protruded-wall surface parts 6 are brought into point contact with the cam sliding surfaces 53*a* of the cam protruded parts 53. In the present invention, movement of the outer ring 5 is determined by shapes of the cam sliding surfaces 53*a*, and the protruded-wall surface parts 6 are pressing members. Therefore, it is sufficient that the protruded-wall surface parts 6 are being pressed from outside. Consequently, a degree of freedom of shapes of the protruded-wall surface parts 6 is high.

On the inner periphery side surface 1*b* of the rotor chamber 1, stopper wall surface parts 1*d* with which the cam protruded parts 53 are brought into contact are formed to control an oscillation angle of the outer ring 5 to be within a predetermined range. Specifically, portions that become steps in a circumferential direction are formed on the inner periphery side surface 1*b*, and the stepped portions are used as the stopper wall surface parts 1*d*. When the outer ring 5 slides to a maximum extent in the circumferential direction, the cam protruded parts 53 are brought into contact with the stopper wall surface parts 1*d*, and the outer ring 5 cannot oscillate any more.

Figure 6:
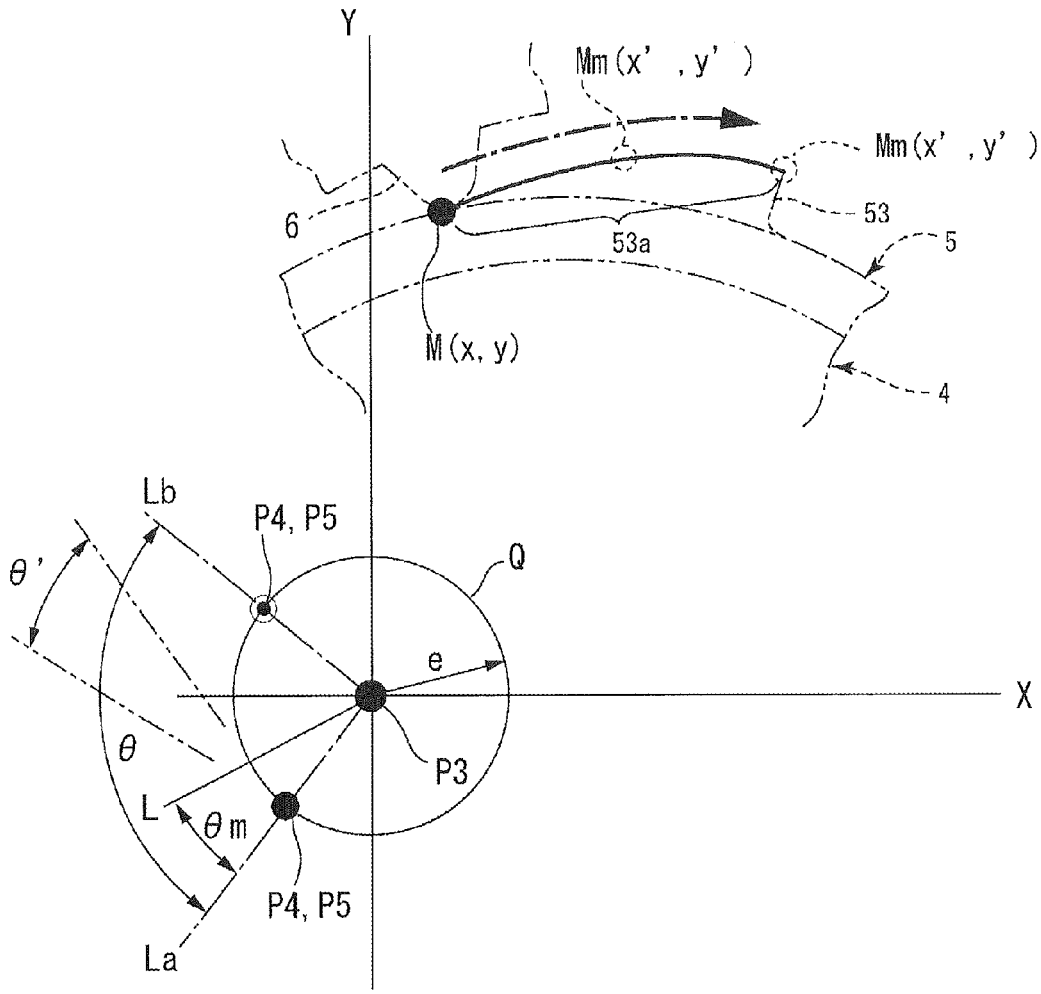
FIG. 6 is an enlarged view of a configuration of a cam sliding surface of a cam protruded part.

Shapes of the cam sliding surfaces 53*a* of the corresponding cam protruded parts 53 of the outer ring 5 are drawn based on the following equations (see FIG. 6). First, the rotation center P3 of the inner rotor 3 is set as an origin or X and Y coordinates of (0, 0). Next, coordinates of a point M at which the cam sliding surface 53*a* and the protruded-wall surface part 6 are brought into contact with each other at the initial position (at a low rotation time) of the outer ring 5 are set as (x, y). The coordinates of the point M are at a position where the outer rotor 4 and the outer ring 5 are in the initial state (see FIGS. 2A and 2B), and the maximum inter-teeth space Smax is present on the initial base line La. Then, the base line L moves by an arbitrary angle from a position of the initial base line La. When a variable at this angle of movement is designated as θm, coordinates (x', y') at a moved point Mm become as follows.

Arbitrary x' is as follows:

$$x'=(x+e^*\cos\theta m)^*\cos(\theta m^*k)-(y-e^*\cos\theta m)^*\sin(\theta m^*k)$$

Arbitrary y' is as follows:

$$y'=(x+e^*\cos\theta m)^*\cos(\theta m^*k)+(y-e^*\cos\theta m)^*\cos(\theta m^*k)+e$$

The angle θm gradually increases, and a locus of movement of the coordinates (x', y') of the point Mm formed by the movement of the base line L from the initial base line La to the terminal base line Lb determines the shape of the cam sliding surface 53*a* of the cam protruded part 53 (see FIG. 6). The cam sliding surface 53*a* formed by the above equations is applied to all the three cam protruded parts 53.

A rotation angle θ' of the outer ring 5 is expressed as $$\theta'=k\theta m$$

where k represents a shortening coefficient. When a value of the shortening coefficient k is smaller, a rotation angle of the outer rotor 4 can be set larger than a rotation angle of the outer ring 5.

A detailed preferable value of the shortening coefficient k is $$0.3\leq k<1.$$

Therefore, the cam sliding surfaces 53*a* of the cam protruded parts 53 of the outer ring 5 have shapes that satisfy the above equation. While oscillating in contact with the protruded-wall surface parts 6, the diameter center P5 of the outer ring 5 moves along the locus Q of a circle (see FIGS. 5A and 5B).

When the inner rotor 3 and the outer rotor 4 are at the initial position, the initial base line La passes through an intermediate position of the suction port 12 in a circumferential direction. In the suction port 12, the inter-teeth space S becomes the maximum inter-teeth space Smax, and the inter-teeth space S becomes a minimum deepest engagement part Smin in the discharge port 13.

When the inner rotor 3 and the outer rotor 4 are at the terminal position, the maximum inter-teeth space Smax having a maximum volumetric capacity of the inter-teeth space S and the deepest engagement part Smin having a minimum volumetric capacity move onto the terminal base line Lb. Therefore, the inter-teeth space S becomes maximum in the first partition part 14, and at the same time, becomes minimum in the second partition part 15.

For the operation means 7, there are used a solenoid valve type, a hydraulic valve type, etc. The operation means 7 directly applies a hydraulic pressure to the oscillation-operation protruded part 54 of the outer ring 5 to operate the oscillation-operation protruded part 54, and oscillates the outer ring 5 to a circumferential direction (see FIGS. 1A and 1E). The operation means 7 has a valve 72 and a spring 73 installed in a valve pump housing 71, and further has two flow paths 74 and 75.

The oscillation-operation protruded part 54 of the outer ring 5 is formed to project from the outer periphery surface 52 to an external side in a diameter direction. The oscillation-operation protruded part 54 is arranged in the operation chamber 2 adjacent to and communicated with the rotor chamber 1.

In the operation chamber 2, the oscillation-operation protruded part 54 has hydraulic-pressure receiving surfaces at both sides in a width (circumferential) direction. The oscillation-operation protruded part 54 has a structure of dividing in watertight the operation chamber 2 into two. Therefore, the oscillation-operation protruded part 54 includes a sealing member 55 having a spring. The oscillation-operation protruded part 54 divides in watertight the operation chamber 2 via the sealing member 55.

The two flow paths 74 and 75 of the operation means 7 are coupled to be communicated with each other from respectively separate positions. Oil is supplied from one of the flow paths 74 and 75, and is flown out from the other one of the flow paths 74 and 75. By oscillating the oscillation-operation protruded part 54 in a circumferential direction in the operation chamber 2, the outer ring 5 is oscillated.

An operation of the internal gear pump according to the present invention is described next. It is assumed that the valve 72 of the operation means 7 is operated by a hydraulic pressure and that the hydraulic pressure changes together with a discharge pressure of the pump. First, during a period from a pump start time to a low rotation time, the inner rotor 3 and the outer rotor 4 rotate by having respective outer teeth 31 and inner teeth 41 engaged with each other, following a rotation of the drive shaft. Then, a volumetric capacity of the inter-teeth space S expands in a former half of the suction port 12. The volumetric capacity is contracted after passing through a latter half of the suction port 12 and the first partition part 14. By changing the volumetric capacity in this way, a pump operation is performed.

When a pump discharge pressure is zero or is extremely low before starting the pump or immediately after starting the pump, the base line L indicating a position of the outer rotor 4 relative to the rotation center P3 of the inner rotor 3 is on the initial base line La. According, when the inner rotor 3 and the outer rotor 4 are in an initial position state, a pump discharge quantity becomes minimum (see FIG. 3A and FIG. 5A).

The rotors become in an intermediate rotation state following an increase in the pump rotation number, and when a pump discharge pressure increases, the operation means 7 operates, and the oil flows from the flow path 75 to the operation chamber 2. The outer ring 5 starts oscillating in the same direction (in the clockwise direction in the present invention) as the rotations of the inner rotor 3 and the outer rotor 4 (see FIG. 3B and FIG. 4A). Accordingly, the base line L moves by the angle θm from the initial base line La, and approaches the terminal base line Lb. The angle θm is a variable.

Figure 4A:
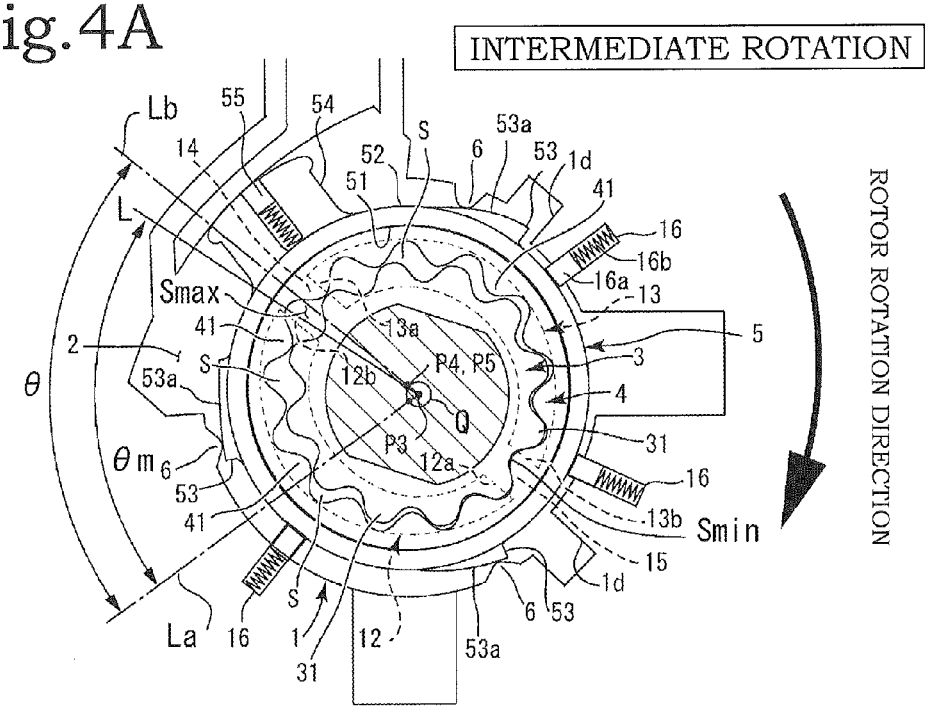
FIG. 4A is a view of a state that the outer rotor is moving from a position of the initial base line to the inner rotor at the intermediate rotation time.
Figure 4B:
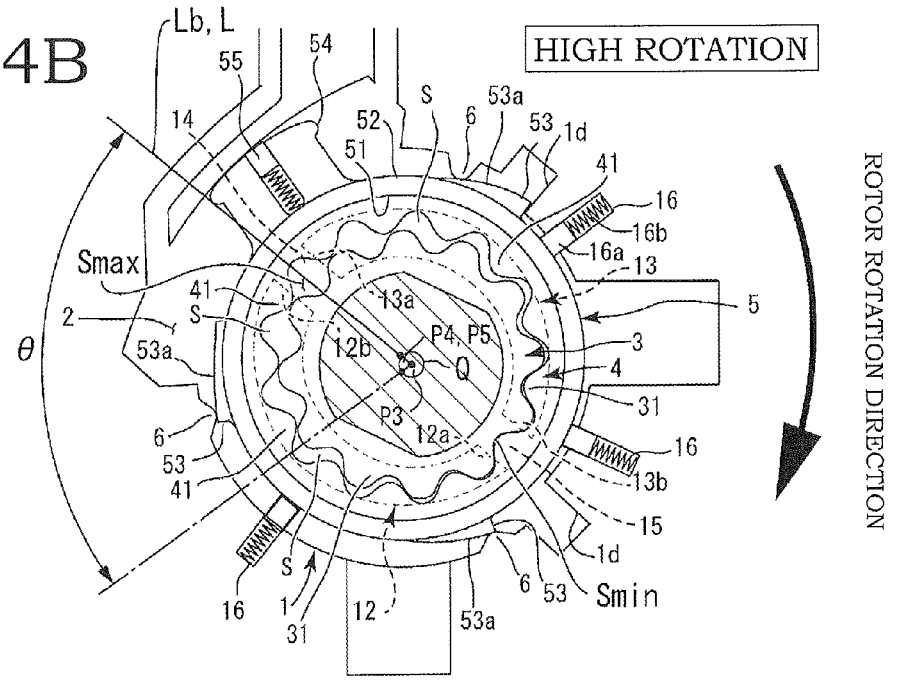
FIG. 4B is a view of a state that the outer rotor reached a terminal base line based on sliding of the outer ring to the inner rotor at a high rotation time.
Figure 5A:
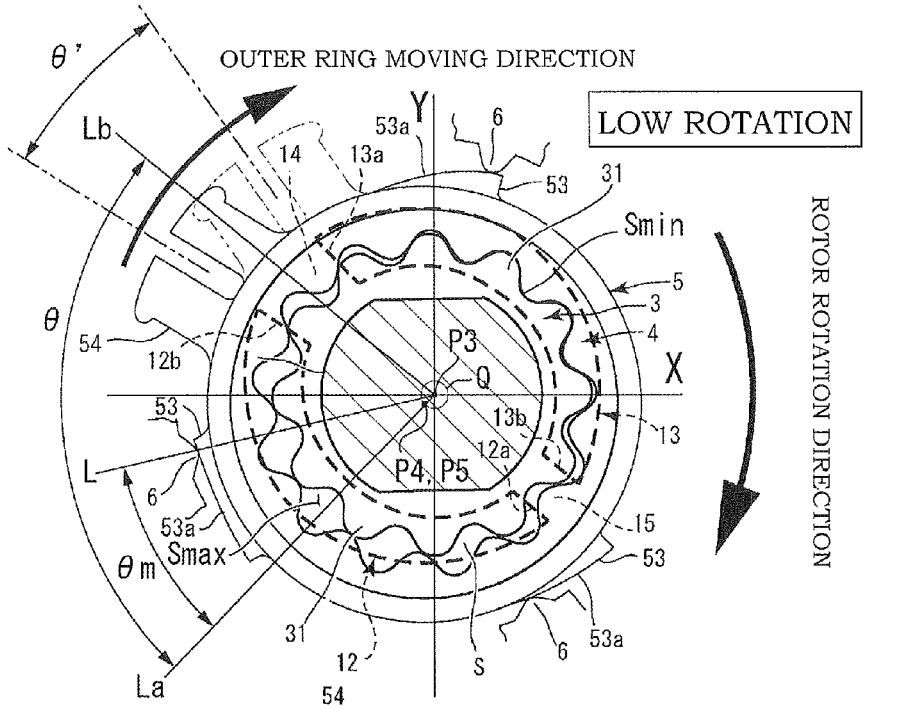
FIG. 5A is a view of the inner rotor, the outer rotor, and the outer ring at a low rotation time.
Figure 5B:
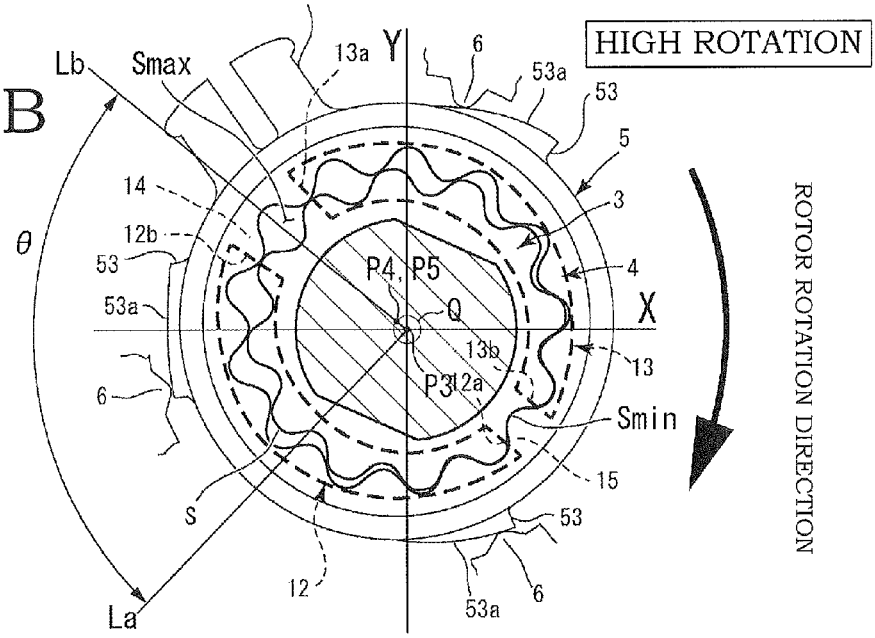
FIG. 5B is a view of the inner rotor, the outer rotor, and the outer ring at a high rotation time.

In a high rotation state when the base line L reaches the terminal base line Lb, a passing position of the maximum inter-teeth space Smax becomes on the first partition part 14 (see FIG. 4B and FIG. 5B). The maximum inter-teeth space Smax passes through the first partition part 14 in a state that a volumetric capacity of the inter-teeth space S is maximum (see FIG. 4B). Therefore, in the high rotation state when the base line L matches the terminal base line Lb, a pump discharge quantity becomes maximum (see FIG. 5B).

In the present invention, the outer ring 5 into which the outer rotor 4 is inserted to be able to rotate freely is oscillated in the rotor chamber 1 by the operation means 7. The outer ring 5 is moved to approximately a tangent direction of the rotor chamber 1 by the operation means 7, and the oscillation angle (the angle θ') of the operation means 7 is small. However, the outer ring 5 itself moves such that the diameter center P5 of the holding-inner peripheral part 51 moves along the locus Q of a circle of which a radius is the eccentricity e to the rotation center P3 of the inner rotor 3.

Therefore, in addition to the movement by the operation means 7 in the tangent direction of the rotor chamber 1, the diameter center P5 of the holding-inner peripheral part 51 of the outer ring 5 moves along the locus Q of a circle. Consequently, the rotation center P4 of the outer rotor 4 inserted into the outer ring 5 can be moved at a larger angle θ than the angle θ' at which the outer ring 5 is oscillated by the operation means 7.

In a state of the initial position, the inter-teeth space S formed by the inner rotor 3 and the outer rotor 4 is small in the first partition part 14. However, based on the large movement of the rotation center P4, as the rotation number increases, phases of the inner rotor 3 and the outer rotor 4 are deviated, and the inter-teeth space S passes through the first partition part 14 in a maximum state. That is, along the increase in the rotation number, the inter-teeth space S of the initial base line La increases while moving toward the terminal base line Lb. The inter-teeth space S is enlarged as the space approaches the terminal base line Lb and is in a maximum state on the terminal base line Lb, and a discharge quantity of the pump relative to the rotation number can be increased.

Further, pressing members 16 for elastically biasing the outer ring 5 at predetermined intervals are provided in the rotor chamber 1 (see FIG. 1A and FIG. 2A). Each pressing member 16 is configured such that a pressing head part 16*a* elastically biases the outer periphery surface 52 of the outer ring 5 with a spring 16*b* so that contact pressures at positions where the cam protruded parts 53 and the corresponding protruded-wall surface parts 6 are brought into contact with each other become approximately equivalent to enable the outer ring 5 to oscillate smoothly. The pressing members 16 also have a function of sealing the oil.

In the present invention, while not particularly shown in the drawings, a covering member for covering the rotor chamber 1 of the pump housing A is included, and the protruded-wall surface parts 6 are installed on the covering member in some cases.

Outlines of other embodiments are described. According to a second implementation mode of the present invention, in contacting and sliding between the protruded-wall surface parts 6 and the corresponding cam protruded parts 53, the protruded-wall surface parts 6 are brought into point contact with the cam protruded parts 53 always at the same portions. Therefore, it is sufficient that precision is high at only one contacting position. Consequently, manufacturing and inspection time of a product can be minimized.

According to a third implementation mode of the present invention, the protruded-wall surface parts 6 have arc shapes at portions that are brought into contact with the corresponding cam protruded parts 53. Accordingly, even when contact angles between the protruded-wall surface parts 6 and the cam protruded parts 53 slightly change, portions where the protruded-wall surface parts 6 and the cam protruded parts 53 are brought into contact with each other are always in point contact, because the contact portions of the protruded-wall surface parts 6 are in arc shapes. Therefore, contacting is performed always in a constant manner, and stable control can be performed.

According to a fourth implementation mode of the present invention, the stopper wall surface parts 1*d* with which the cam protruded parts 53 are brought into contact are formed in the rotor chamber 1 to control the oscillation angle of the outer ring 5 to be within a predetermined range. Therefore, the outer ring 5 can be securely operated within a predetermined oscillation range.

EXPLANATION OF REFERENCE NUMERALS

A PUMP HOUSING
1 ROTOR CHAMBER
1*d* STOPPER WALL SURFACE PART
3 INNER ROTOR
4 OUTER ROTOR
5 OUTER RING
51 HOLDING-INNER PERIPHERAL PART
52 OUTER PERIPHERY SURFACE
53 CAM PROTRUDED PART
6 PROTRUDED-WALL SURFACE PART
7 OPERATION MEANS
P3 ROTATION CENTER (OF INNER ROTOR)
P4 ROTATION CENTER (OF OUTER ROTOR)
P5 DIAMETER CENTER (OF OUTER RING)
Q LOCUS OF CIRCLE
e ECCENTRICITY

What is claimed is:

1. An internal gear pump comprising:

an inner rotor;

an outer rotor that rotates by having a predetermined eccentricity to a rotation center of the inner rotor;

an outer ring that includes a holding-inner peripheral part which holds the outer rotor in a freely rotatable state, and at least three cam protruded parts formed along a circumferential direction of an outer periphery surface of the outer ring;

a pump housing that has a rotor chamber in which the outer ring is freely oscillatably arranged;

protruded-wall surface parts that are formed on an inner periphery side surface of the rotor chamber, are formed in the same number as that of the cam protruded parts, and are always brought into contact with the cam protruded parts; and operation means for oscillating the outer ring, wherein positions of the protruded-wall surface parts are set so that a diameter center of the holding-inner peripheral part of the outer ring is moved by the operation means along a locus of a circle of which a radius is the eccentricity to the rotation center of the inner rotor, wherein, in contacting and sliding between the protruded-wall surface parts and the cam protruded parts, the protruded-wall surface parts are brought into point contact with the cam protruded parts such that positions of point contact between the cam protruded parts and the protruded-wall surface parts always contact each other during operation of the internal gear pump, and wherein a cam sliding surface of each of the cam protruded parts is formed in a shape of an inclined surface that is gradually separated from the outer periphery surface of the outer ring from one end toward an other end along the circumferential direction.

2. The internal gear pump according to claim 1, wherein the protruded-wall surface parts comprise arc shapes at portions that are brought into contact with the cam protruded parts.

3. The internal gear pump according to claim 2, wherein in the rotor chamber, stopper wall surface parts with which the cam protruded parts are brought into contact are formed to control an oscillation angle of the outer ring to be within a predetermined range.

4. The internal gear pump according to claim 1, wherein in the rotor chamber, stopper wall surface parts with which the cam protruded parts are brought into contact are formed to control an oscillation angle of the outer ring to be within a predetermined range.

5. The internal gear pump according to claim 1, wherein an internal diameter of the holding-inner peripheral part is greater than an external diameter of the outer rotor.

* * * * *